US010872567B2

(12) United States Patent
Zhang et al.

(10) Patent No.: US 10,872,567 B2
(45) Date of Patent: Dec. 22, 2020

(54) METHOD FOR DRIVING DISPLAY DEVICE

(71) Applicant: KUNSHAN GO-VISIONOX OPTO-ELECTRONICS CO., LTD., Jiangsu (CN)

(72) Inventors: Shuhuan Zhang, Jiangsu (CN); Haibin Jiang, Jiangsu (CN); Xinquan Chen, Jiangsu (CN)

(73) Assignee: KUNSHAN GO-VISIONOX OPTO-ELECTRONICS CO., LTD., Jiangsu (CN)

( * ) Notice: Subject to any disclaimer, the term of this patent is extended or adjusted under 35 U.S.C. 154(b) by 0 days.

(21) Appl. No.: 16/324,309

(22) PCT Filed: Mar. 6, 2018

(86) PCT No.: PCT/CN2018/078170
§ 371 (c)(1),
(2) Date: Sep. 17, 2019

(87) PCT Pub. No.: WO2018/161902
PCT Pub. Date: Sep. 13, 2018

(65) Prior Publication Data

US 2020/0090589 A1 Mar. 19, 2020

(30) Foreign Application Priority Data

Mar. 10, 2017 (CN) ..... 2017 1 0142298

(51) Int. Cl.
*G09G 3/3258* (2016.01)
*G09G 3/20* (2006.01)

(52) U.S. Cl.
CPC ..... *G09G 3/3258* (2013.01); *G09G 3/2007* (2013.01); *G09G 2320/0233* (2013.01); *G09G 2330/02* (2013.01)

(58) Field of Classification Search
CPC ..... G09G 3/2007; G09G 3/3258
USPC ..... 345/76, 212, 694; 257/40, 565; 315/161; 327/103, 175
See application file for complete search history.

(56) References Cited

U.S. PATENT DOCUMENTS

| | | | | |
|---|---|---|---|---|
| 8,248,329 | B2 | 8/2012 | Yamamoto et al. | |
| 2006/0022305 | A1* | 2/2006 | Yamashita | G09G 3/2014 257/565 |
| 2011/0115832 | A1 | 5/2011 | Lee et al. | |
| 2011/0134101 | A1 | 6/2011 | Yamashita et al. | |
| 2011/0221784 | A1 | 9/2011 | Lee et al. | |

(Continued)

FOREIGN PATENT DOCUMENTS

| | | |
|---|---|---|
| CN | 102640091 A | 8/2012 |
| CN | 103177693 A | 6/2013 |

(Continued)

*Primary Examiner* — Prabodh M Dharia
(74) *Attorney, Agent, or Firm* — Muncy, Geissler, Olds & Lowe, P.C.

(57) ABSTRACT

The present application discloses a method for driving a display apparatus. The display apparatus includes an OLED and a driver transistor. An anode of the OLED is connected to a source of the driver transistor, a drain of the driver transistor is connected to a positive power supply, a cathode of the OLED is connected to a negative power supply, and a voltage difference between the positive power supply and the negative power supply is in a range from 7.1 V to 9.6 V.

10 Claims, 3 Drawing Sheets

(56) References Cited

U.S. PATENT DOCUMENTS

| | | | | |
|---|---|---|---|---|
| 2013/0016086 | A1 | 1/2013 | Ebisuno et al. | |
| 2013/0021228 | A1 | 1/2013 | Miwa et al. | |
| 2013/0088416 | A1* | 4/2013 | Smith | G09G 3/3233 345/76 |
| 2013/0307601 | A1* | 11/2013 | Castor-Perry | H03K 5/084 327/175 |
| 2014/0354624 | A1 | 12/2014 | Chaji | |
| 2015/0187291 | A1* | 7/2015 | Jang | G09G 3/3655 345/694 |
| 2015/0220093 | A1* | 8/2015 | Pude | G05F 1/575 327/103 |
| 2015/0311265 | A1* | 10/2015 | Matsueda | H01L 27/3211 257/40 |
| 2016/0029456 | A1* | 1/2016 | Xie | G09G 3/36 315/161 |
| 2017/0018220 | A1 | 1/2017 | Takahara | |
| 2018/0211601 | A1* | 7/2018 | Chen | G09G 3/3258 |
| 2018/0226020 | A1* | 8/2018 | Wang | G09G 3/3266 |
| 2019/0172395 | A1* | 6/2019 | Yuan | G09G 3/3291 |

FOREIGN PATENT DOCUMENTS

| | | | | |
|---|---|---|---|---|
| CN | 103646629 | | * 12/2013 | G09G 3/3258 |
| CN | 103646629 | B | * 12/2013 | G09G 3/3258 |
| CN | 103646629 | A | 3/2014 | |
| CN | 104036724 | A | 9/2014 | |
| CN | 104751786 | A | 7/2015 | |
| CN | 105405403 | A | 3/2016 | |
| JP | 2009109984 | A | 5/2009 | |
| JP | 2011118079 | A | 6/2011 | |
| JP | 2011118301 | A | 6/2011 | |
| KR | 20110103755 | A | 9/2011 | |
| TW | 564390 | B | 12/2003 | |
| TW | 200717430 | A | 5/2007 | |
| TW | 200802274 | A | 1/2008 | |
| TW | 201606738 | A | 2/2016 | |
| WO | WO-2013008270 | A1 | 1/2013 | |

* cited by examiner

METHOD FOR DRIVING DISPLAY DEVICE

TECHNICAL FIELD

The present application relates to the field of display, particularly to a method for driving a display apparatus.

BACKGROUND

A flat panel display apparatus has many advantages such as a slim body power saving, and no radiation, and therefore, is widely applied. Existing flat panel display apparatuses mainly include Liquid Crystal Displays (LCDs) and Organic Light-Emitting Diode (OLED) display apparatuses.

The OLED display apparatus is a main force in next-generation flat panel display apparatuses. Compared with other flat panel display apparatuses represented by the LCD, the OLED display apparatus has many advantages such as low costs, self-illumination, a wide angle of view, a low voltage, a low power consumption, a all-solid-state display anti-vibration, a high reliability, and a quick response.

The OLED display apparatus may include a plurality of pixel cells. Each pixel cell includes an OLED as a light-emitting element of the pixel cell. And the OLED display apparatus may further include a driver chip. The driver chip is configured to provide a data signal $V_{data}$ (that is, a Gamma voltage displayed on different grayscales, usually including 0 to 255 scales) to each pixel cell. Brightness of the OLED is controlled by a magnitude of a current flowing through the OLED, and a high order grayscale unsmooth transition phenomenon exists in existing OLED display apparatuses, and severely affects a normal use of existing OLED display apparatuses.

SUMMARY OF THE INVENTION

An objective of the present application is to provide a method for driving a display apparatus, to alleviate a high order grayscale unsmooth transition phenomenon.

To resolve the foregoing technical problem, the present application provides a method for driving a display apparatus, wherein the display apparatus includes an OLED and a driver transistor, an anode of the OLED connected to a source of the driver transistor, and the method including:

connecting a drain of the driver transistor to a positive power supply;

connecting a cathode of the OLED to a negative power supply; and configuring a voltage difference between the positive power supply and the negative power supply in a range from 7.1 V to 9.6 V.

Optionally, for the method for driving a display apparatus, a voltage provided by the positive power supply has a fixed value, and a voltage provided by the negative power supply is an adjustable voltage.

Optionally, for the method for driving a display apparatus, the voltage provided by the positive power supply ranges from 4 V to 5 V.

Optionally, for the method for driving a display apparatus, the voltage provided by the negative power supply ranges from −5 V to −2.5 V.

Optionally, for the method for driving a display apparatus, the voltage difference between the positive power supply and the negative power supply is configured in a range from 8.1 V to 9.1 V.

Optionally, for the method for driving a display apparatus, the voltage provided by the negative power supply ranges from −4.5 V to −3.5 V.

Optionally, for the method for driving a display apparatus, a voltage provided by the positive power supply is an adjustable voltage, and a voltage provided by the negative power supply has a fixed value.

Optionally, for the method for driving a display apparatus, a drain-source voltage of the driver transistor is as follows:

$V_{ds}$=a voltage of the positive power supply−a voltage of the negative power supply $-V_{oled}$, where $V_{ds}$ is the drain-source voltage of the driver transistor, and $V_{oled}$ is a voltage of two terminals of the OLED.

Optionally, for the method for driving a display apparatus, the display apparatus further includes a capacitor, and a gate of the driver transistor is connected to the positive power supply through the capacitor.

Optionally, for the method for driving a display apparatus, the display apparatus has a 2T1C structure or a 4T1C structure or a 6T1C structure or a 7T1C structure.

In the method for driving a display apparatus provided by the present application, the display apparatus includes an OLED and a driver transistor. An anode of the OLED is connected to a source of the driver transistor. A drain of the driver transistor is connected to a positive power supply. A cathode of the OLED is connected to a negative power supply, and a voltage difference between the positive power supply and the negative power supply is configured in a range from 7.1 V to 9.6 V. In this way, a high order grayscale unsmooth transition phenomenon of a module caused by a relatively low division voltage of the driver transistor because of a relatively high division voltage of the OLED can be effectively eliminated, and the driver transistor can keep working in a saturated region, thereby avoiding occurrence of the high order grayscale unsmooth transition phenomenon and improving a production yield.

DETAILED DESCRIPTION

The method for driving a display apparatus of the present application is described below in more details with reference to the schematic diagrams, where preferred embodiments of the present application are presented. It should be understood that a person skilled in the art can modify the present application described herein while still achieving advantageous effects of the present application. Therefore, the following descriptions should be understood as being well-known to a person skilled in the art, and are not intended to limit the present application.

The present application is described in more details in the following paragraphs by using examples with reference to the accompanying drawings. The advantages and features of the present application are more comprehensible according to the following descriptions and claims. It should be noted that the accompanying drawings are all in simplified forms, with the only intention to facilitate convenience and clarity in explaining the Objectives of the embodiments of the present application.

Figure 1:
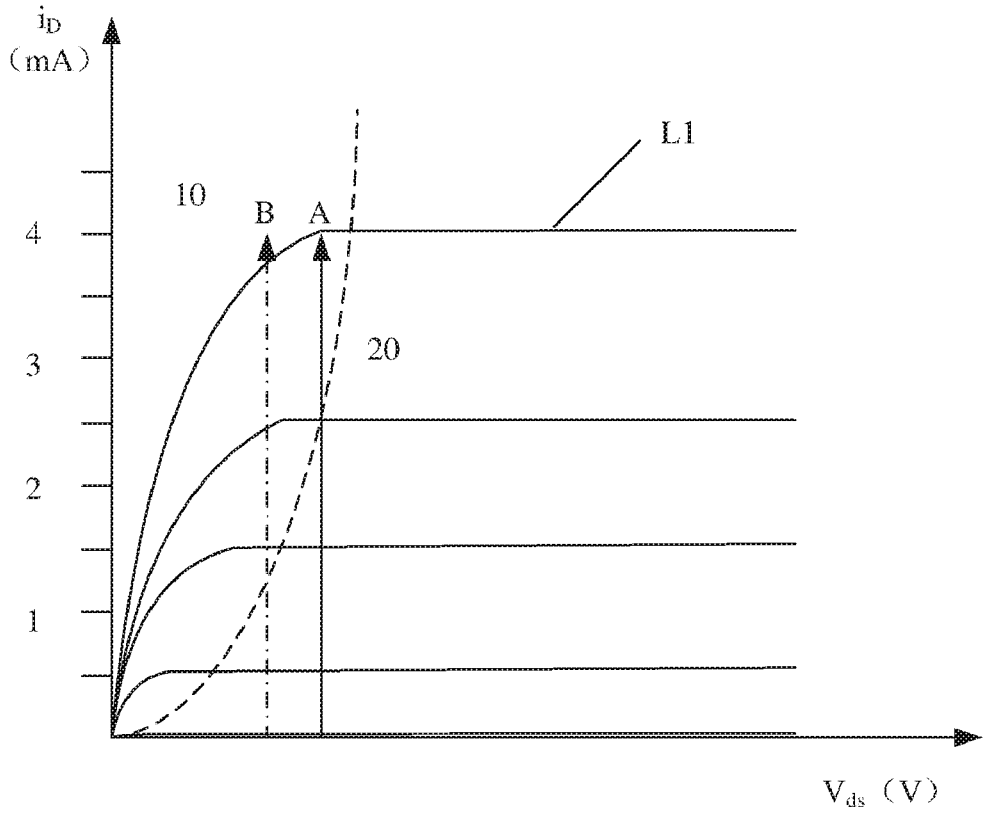
FIG. 1 is a schematic diagram of an output characteristic curve of a driver transistor of a display apparatus.

The high order grayscale unsmooth transition phenomenon has been studied by the inventor, and according to a great amount of experimental analysis, the inventor found that under same brightness (that is, a magnitude of a current flowing through the OLED is unchanged) and on a high order grayscale, a relatively high division voltage of the OLED leads to a relatively low division voltage of the drain-source voltage of the driver transistor connected to the OLED in the circuit. Hence, in the output characteristic curve (a horizontal coordinate represents a drain-source voltage, and a vertical coordinate presents a drain current) of the driver transistor as shown in FIG. 1, a magnitude of a drain-source voltage of the driver transistor corresponding to a gray scale V255 is moved from a solid line arrow A to a dashed line arrow B, that is, the driver transistor switches from the saturated region 20 to a variable resistance region 10 (a left half part of a curve L1 corresponds to the variable resistance region 10, a right half part corresponds to the saturated region 20, and the output characteristic curve further includes a breakdown region, which is not shown in the figure). Consequently, a current flowing through the driver transistor and the OLED is unstable, and forms a high order grayscale unsmooth transition phenomenon.

Based on this, the present application provides a method for driving a display apparatus, where the display apparatus includes an OLED and a driver transistor, and an anode of the OLED is connected to a source of the driver transistor. In this method, a drain of the driver transistor is connected to a positive power supply, a cathode of the OLED is connected to a negative power supply, and a voltage difference between the positive power supply and the negative power supply is configured in a range from 7.1 V to 9.6 V.

Preferred embodiments of the method for driving a display apparatus are exemplified below, to clearly describe the content of the present application. It should be clarified that the content of the present application is not limited to the following embodiments. Other improvements made by a person of ordinary skill in the art through common technical methods also fall within the scope of the content of the present application.

The method for driving a display apparatus of the present application is described below in great detail with reference to FIG. 2 and FIG. 3.

In the method for driving a display apparatus of the present application, the display apparatus includes an OLED D1 (Organic Light-Emitting Diode) and a driver transistor DTFT (Driver Thin Film Transistor), where an anode of the OLED is connected to a source of the driver transistor DTFT. As shown in FIG. 3, the method includes:

step S11: connecting a drain of the driver transistor DTFT to a positive power supply Vdd.

step S12: connecting a cathode of the OLED to a negative power supply $V_{ss}$.

step S13: configuring a voltage difference between the positive power supply Vdd and the negative power supply $V_{ss}$ in a range from 7.1 V to 9.6 V.

step S11 and step S12 can be performed in another sequence, for example, be simultaneously performed.

In an embodiment, a voltage provided by the positive power supply $V_{dd}$ has a fixed value, and a voltage provided by the negative power supply $V_{ss}$ is adjustable. The voltage provided by the positive power supply $V_{dd}$ can be selected from a range of 4 V to 5 V For example, the voltage provided by the positive power supply $V_{dd}$ is 4.6 V and the voltage provided by the negative power supply $V_{ss}$ ranges from −5 V to −2.5 V Considering that external environmental factors (such as a temperature and material) also affect a working voltage of the driver transistor DTFT, the voltage of the negative power supply $V_{ss}$ may have a specific variation range so as to ensure that the driver transistor DTFT is in the saturated region. Further, the voltage of negative power supply Vss also relates to power consumption of the display apparatus. This embodiment may further define that a voltage difference between the positive power supply Vdd and the negative power supply $V_{ss}$ ranges from 8.1 V to 9.1 V Similarly, in an example where the voltage provided by the positive power supply Vdd is 4.6 V, the selectable voltage of the negative power supply $V_{ss}$ ranges from −4.5 V to −3.5 V Such a voltage range is obtained by taking the foregoing factors into consideration. The voltage range not only can ensure that the driver transistor DTFT is in the saturated region so as to improve a high order grayscale color accuracy, but also can make power consumption of the display apparatus fall within an acceptable range, and can further enable the display apparatus to endure an impact of most environments (for example, cloudy and rainy weather).

It can be understood that in the method for driving a display apparatus of the present application, the voltage provided by the positive power supply Vdd may alternatively be adjustable, and the voltage provided by the negative power supply Vss may have a fixed value, provided that the voltage difference between the positive power supply and the negative power supply is configured in a range from 7.1 V to 9.6 V to ensure that the driver transistor. DTFT is in the saturated region so as to improve a high order grayscale color accuracy, and further to avoid a high order grayscale unsmooth transition phenomenon of a module. FIG. 2 provides a schematic diagram of a display apparatus of the present application. As shown in FIG. 2, a drain-source voltage $V_{ds}$ of the driver transistor DTFT=a positive power supply voltage $V_{dd}$−a negative power supply voltage $V_{ss}$−$V_{oled}$, where the $V_{oled}$ is a voltage between the two terminals of the OLED, It is certain that when a device is normal, the $V_{oled}$ is unchanged, so that in the present application, configuring a voltage difference between the positive power supply $V_{dd}$ and the negative power supply $V_{ss}$ (that is, the positive power supply voltage $V_{dd}$−the negative power supply voltage $V_{ss}$) in a range from 7.1 V to 9.6 V, for example, 8.0 V, 8.2 V, 8.3 V, 8.5 V, 8.7 V, and 8.9 V or the like, can increase the drain-source voltage $V_{ds}$ of the driver transistor. DTFT. With combined reference to FIG. 1, the increased $V_{ds}$ can make it easier for the driver transistor DTFT to work in the saturated region, thereby avoiding a fluctuation of a current flowing through the driver transistor and the OLED caused by a fluctuation of resistance of the driver transistor so that occurrence of a high order grayscale unsmooth transition phenomenon is avoided.

In positive power supply voltages d negative power supply voltages $V_{ss}$ generated by most power supply ICs, the positive power supply voltage $V_{dd}$ is fixed. Hence, in the foregoing text, the voltage of the negative power supply $V_{ss}$ is limited to a particular range to achieve an objective of alleviating a high order grayscale unsmooth transition phenomenon. It can be understood that, in a case in which the positive power supply voltage $V_{dd}$ is adjustable, the method of the present application can still be used. For example, the negative power supply voltage $V_{ss}$ may be fixed, and a range of the positive power supply voltage $V_{dd}$ may be limited, provided that a voltage difference between the positive power supply voltage $V_{dd}$ and the negative power supply voltage $V_{ss}$ is configured to range from 7.1 V to 9.6 V. In addition, alternatively, both of the positive power supply voltage $V_{dd}$ and the negative power supply voltage $V_{ss}$ may be adjustable, provided that the voltage difference between the positive power supply voltage $V_{dd}$ and the negative power supply voltage $V_{ss}$ is configured to range from 7.1 V to 9.6 V. Based on the disclosure of the present application, a person skilled in the art knows how to design.

Figure 2:
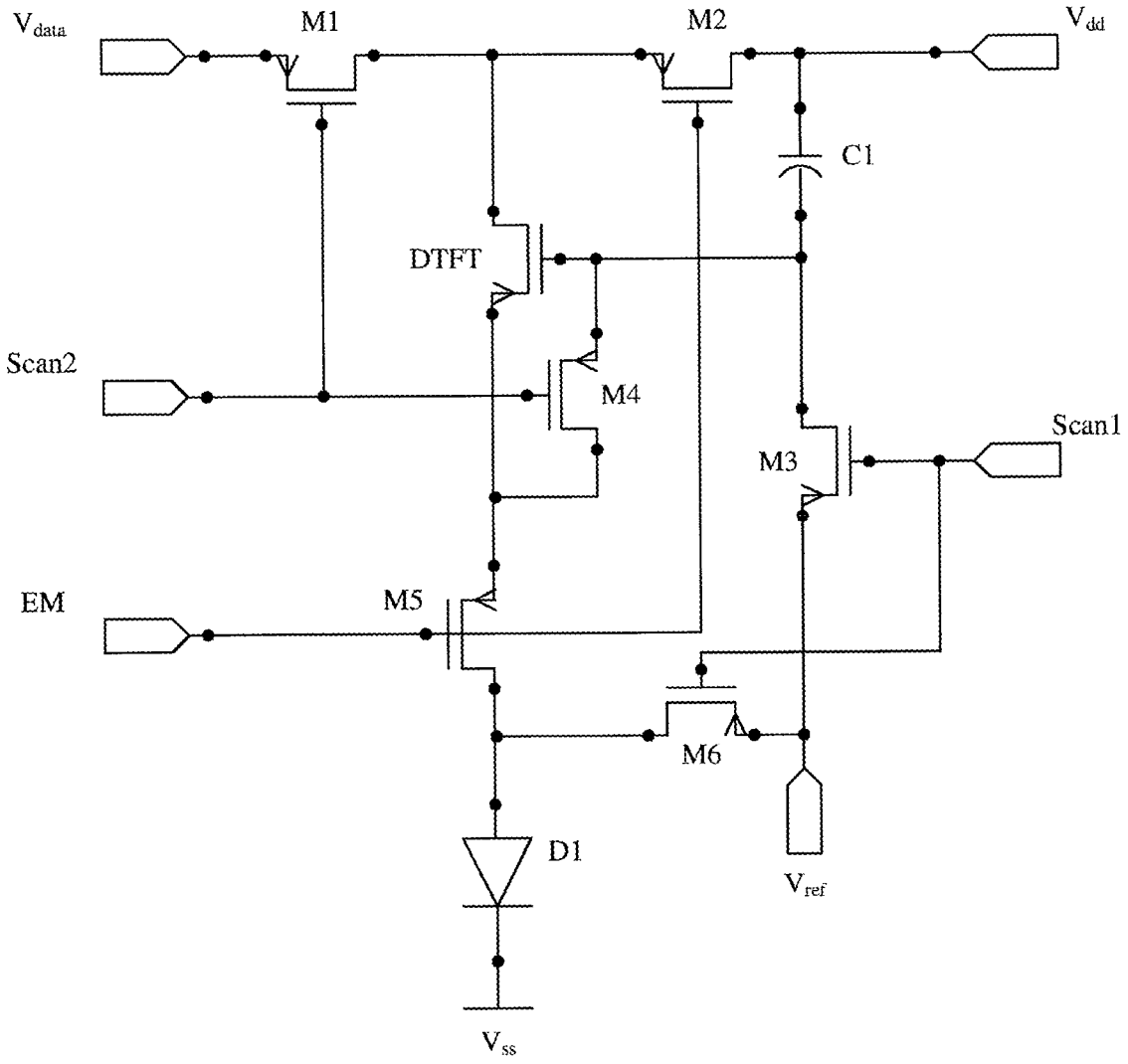
FIG. 2 is a schematic structural diagram of a display apparatus according to the present application.
Figure 3:
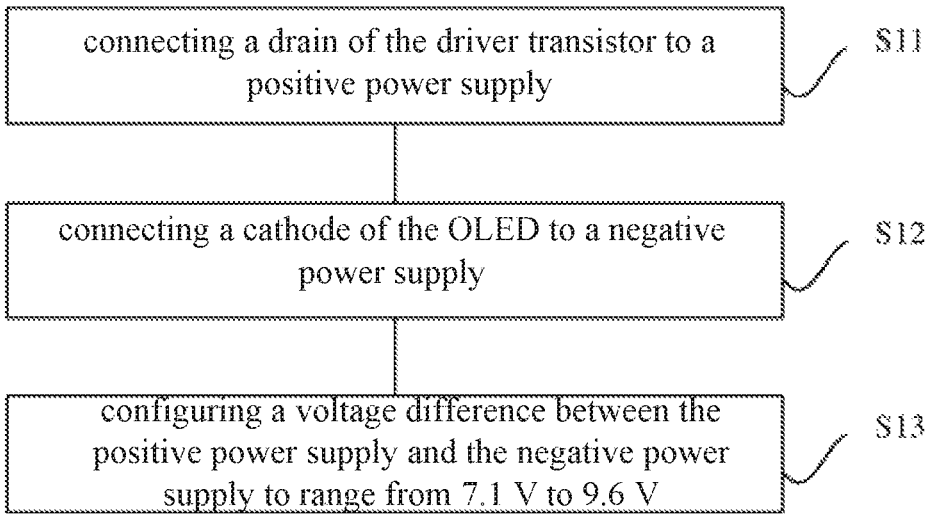
FIG. 3 is a flowchart of a method for driving a display apparatus according to the present application.

With continued reference to FIG. 2, the display apparatus further includes a capacitor C1, where a gate of the driver transistor DTFT is connected to the positive power supply $V_{dd}$ through the capacitor C1.

As shown in FIG. 2, the method of the present application is applied by using a 7T1C structure (7 thin film transistors and 1 capacitor). The 7T1C structure may be as follows.

The display apparatus further includes: a first switch transistor M1 (as shown in FIG. 2, each of the transistors in this embodiment is a PMOS). A source of the first switch transistor M1 is connected to a data signal power supply $V_{data}$. The data signal power supply $V_{data}$ provides a Gamma voltage for different gray scales, and a drain of the first switch transistor M1 is connected to the drain of the driver transistor DTFT. The display apparatus further includes a second switch transistor M2. A source of the second switch transistor M2 is connected to the drain of the driver transistor DTFT, and a drain of the second switch transistor M2 is connected to the positive power supply $V_{dd}$. The display apparatus further includes a third switch transistor M3. A drain of the third switch transistor M3 is connected to the gate of the driver transistor DTFT, a source of the third switch transistor M3 is connected to a reference power supply $V_{ref}$, and a gate of the third switch transistor M3 is connected to a first scan power supply Scan1. The display apparatus further includes a fourth switch transistor M4 and a fifth switch transistor M5. A source of the fourth switch transistor M4 is connected to the gate of the driver transistor DTFT, a drain of the fourth switch transistor M4 is connected a source of the fifth switch transistor M5, and a gate of the fourth switch transistor M4 is connected to a second scan power supply Scan2. A drain of the fifth switch transistor M5 is connected to the anode of the OLED, a source of the fifth switch transistor M5 is further connected to the source of the driver transistor DTFT, and a gate of the fifth switch transistor M5 is connected to an emission power supply EM. A gate of the second switch transistor M2 is connected to the emission power supply EM, and a gate of the first switch transistor M1 is connected to the second scan power supply Scan2. The display apparatus further includes a sixth switch transistor M6, a source of the sixth switch transistor M6 is connected to the reference power supply $V_{ref}$, a drain of the sixth switch transistor is connected to the anode of the OLED, and a gate of the sixth switch transistor M6 is connected to the first scan power supply Scan1.

In conclusion, in the method for driving a display apparatus provided by the present application, the display apparatus includes an OLED and a driver transistor. An anode of the OLED is connected to a source of the driver transistor, a drain of the driver transistor is connected to a positive power supply; and a cathode of the OLED is connected to a negative power supply so that a voltage difference between the positive power supply and the negative power supply is configured to range from 7.1 V to 9.6 V In this way, a high order grayscale unsmooth transition phenomenon of a module caused by a relatively low division voltage of the driver transistor because of a relatively high division voltage of the OLED can be effectively eliminated, and the driver transistor can keep working in a saturated region, thereby avoiding the occurrence of the high order grayscale unsmooth transition phenomenon and improving a production yield.

It should be noted that although the foregoing text is described by using an example of a 7T1C structure (7 thin film transistors and 1 capacitor), in fact, connection relationships among the first to fifth switch transistors may have some changes. In addition, the driving method is also applicable to driving a display apparatus having another quantity of thin film transistors and/or capacitors, for example, may be applied to driving a display apparatus of a structure such as 2T1C, 4T1C, or 6T1C and the like. However, specific structures such as 2T1C, 4T1C, and 6T1C are well-known to a person skilled in the art. On the basis of the 7T1C structure in the foregoing text, a person skilled in the art can know a structure to which the driving method of the present application is applicable, which are not described herein by using examples one by one.

Apparently, a person skilled in the art can make various modifications and variations on the present application without departing from the spirit and scope of the present application. Hence, if the modifications and variations on the present application belong to the present application and the scope of its equivalent technology, the present application is also intended to cover the modifications and variations.

What is claimed is:

1. A method for driving a display apparatus, wherein the display apparatus comprises an OLED, a driver transistor and first to fourth switch transistors, the method comprising:

connecting a source of the first switch transistor to a data signal power supply, connecting a drain of the first switch transistor to a drain of the driver transistor and connecting a gate of the first switch transistor to a second scan power supply; connecting a source of the second switch transistor to the drain of the driver transistor, connecting a drain of the second switch transistor to a positive power supply and connecting a gate of the second switch transistor to an emission power supply; connecting a source of the third switch transistor to a reference power supply, connecting a drain of the third switch transistor to a gate of the driver transistor and connecting a gate of the third switch transistor to a first scan power supply; connecting a source of the fourth switch transistor to a gate of the driver transistor, connecting a drain of the fourth switch transistor to a source of the fifth switch transistor and connecting a gate of the fourth switch transistor to the second scan power supply;

connecting a cathode of the OLED to a negative power supply; and conducting a voltage difference between the positive power supply and the negative power supply in a range from 7.1 V to 9.6 V.

2. The method for driving a display apparatus according to claim 1, wherein a voltage provided by the positive power supply has a fixed value, and a voltage provided by the negative power supply is an adjustable voltage.

3. The method for driving a display apparatus according to claim 2, wherein the voltage provided by the positive power supply ranges from 4 V to 5 V.

4. The method for driving a display apparatus according to claim 2, wherein the voltage provided by the negative power supply ranges from −5 V to −2.5 V.

5. The method for driving a display apparatus according to claim 2, wherein the voltage difference between the positive power supply and the negative power supply is configured in a range from 8.1 V to 9.1 V.

6. The method for driving a display apparatus according to claim 5, wherein the voltage provided by the negative power supply ranges from −4.5 V to −3.5 V.

7. The method for driving a display apparatus according to claim 1, wherein a voltage provided by the positive power supply is an adjustable voltage, and a voltage provided by the negative power supply has a fixed value.

8. The method for driving a display apparatus according to claim 1, wherein a drain-source voltage of the driver transistor is as follows:

$V_{ds}$=a voltage of the positive power supply−a voltage of the negative power supply−$V_{oled}$, $V_{ds}$ is the drain-source voltage of the driver transistor, and $V_{oled}$ is a voltage between two terminals of the OLED.

9. The method for driving a display apparatus according to claim 1, wherein the display apparatus further comprises a capacitor, a gate of the driver transistor connected to the positive power supply through the capacitor.

10. The method for driving a display apparatus according to claim 1, further comprising: connecting a source of the fifth switch transistor to a source of the driver transistor, connecting a drain of the fifth switch transistor to an anode of the OLED and connecting a gate of the fifth switch transistor to the emission power supply; connecting a source of the sixth switch transistor to a reference power supply, connecting a drain of the sixth switch transistor to the anode of the OLED and connecting a gate of the sixth switch transistor to the first scan power supply.

* * * * *